US007121410B2

(12) United States Patent
Rohrmus et al.

(10) Patent No.: US 7,121,410 B2
(45) Date of Patent: Oct. 17, 2006

(54) BLISTER PACK

(75) Inventors: Manfred Rohrmus, Renningen (DE); Günter Albrecht, Karlsruhe (DE); Jörg-Uwe Bippus, Ettlingen (DE); Udo Guth, Eggenstein-Leopoldshafen (DE)

(73) Assignee: Romaco Pharmatechnik GmbH, Karlsruhe (DE)

( * ) Notice: Subject to any disclaimer, the term of this patent is extended or adjusted under 35 U.S.C. 154(b) by 40 days.

(21) Appl. No.: 11/135,791

(22) Filed: May 24, 2005

(65) Prior Publication Data

US 2005/0269236 A1 Dec. 8, 2005

(30) Foreign Application Priority Data

Jun. 5, 2004 (DE) ..... 10 2004 027 590

(51) Int. Cl.
*B65D 83/04* (2006.01)

(52) U.S. Cl. ..... 206/531; 206/534.1; 206/469

(58) Field of Classification Search ..... 206/528, 206/530, 531, 532, 534, 534.1, 538, 539, 206/469
See application file for complete search history.

(56) References Cited

U.S. PATENT DOCUMENTS 3,809,221 A * 5/1974 Compere ..... 206/531
3,912,081 A * 10/1975 Haines et al. ..... 206/531
4,537,312 A * 8/1985 Intini ..... 206/531
4,666,040 A * 5/1987 Murata ..... 206/441
5,172,812 A * 12/1992 Wharton et al. ..... 206/531
5,775,505 A * 7/1998 Vasquez et al. ..... 206/538
6,155,423 A * 12/2000 Katzner et al. ..... 206/531
2002/0166790 A1* 11/2002 Aylward ..... 206/531

* cited by examiner

*Primary Examiner*—Luan K. Bui
(74) *Attorney, Agent, or Firm*—Klaus J. Bach

(57) ABSTRACT

In a blister pack comprising a base foil with chambers formed therein for receiving a product sealed into the chambers, a rupture foil disposed on the base foil to close and seal the chambers and a plastic foil disposed on the rupture foil for the protection of the rupture foil, wherein the plastic foil is attached to the rupture foil with a retaining force which is lower than the force with which the rupture foil is attached to the base foil, except for a limited edge area of the rupture foil which is delimited by a seal edge and a perforation extending along the seal edge, so that, upon removal of the plastic foil and the rupture foil from the base foil in the limited edge area where the rupture foil is not attached to the base foil, the rupture foil breaks away from the plastic foil when reaching the perforated seal edge so that the chamber remains reliably covered by the rupture foil while the plastic foil is peeled off the rupture foil.

2 Claims, 1 Drawing Sheet

BLISTER PACK

BACKGROUND OF THE INVENTION

The invention relates to a blister pack comprising a base foil with at least one chamber closed by a rupture foil in such a way that the rupture foil is firmly connected to the base foil except for a limited area and a cover foil is disposed on top of the rupture foil which cover foil is less firmly attached to the rupture foil than the rupture foil is attached to the base foil so that the cover foil can be removed without affecting the rupture foil.

Such a blister pack is known for example from a brochure "Blister Lidding" of the company Lawson Mardon Singen GmbH. In this known blister pack, several areas of a base foil, each of which includes a chamber obtained by cupping, are separated from one another by grid-like arranged perforation lines. The chambers which generally receive medications are closed by an aluminum foil cemented onto the base foil. On the aluminum foil, a removable foil is disposed at its side remote from the base foil.

At the crossing points of the perforation lines circular areas are formed in which the aluminum foil is not connected to the base foil. In these so-called seal-free areas, the aluminum foil is not attached to the base foil so that it, and the removable foil disposed thereon can be grasped with the fingers.

The removable foil is disposed on the aluminum foil with a retaining force which is smaller than that with which the aluminum foil is mounted to the base foil. In this way, the removable foil can easily be removed from the aluminum foil without the aluminum foil being removed from the base foil.

Since the aluminum foil and the removable foil are so sized that the products contained in the chambers can be pressed through the rupturing aluminum foil only when the removable foil is removed, the removal of the products from the blister pack is difficult. Such blister packs are therefore called child-safe blister packs.

Although the removable foil is attached to the aluminum foil with a lower retaining force than the aluminum foil is attached to the base foil so that the removable foil can be removed from the aluminum foil, it happens quite frequently that, starting at the seal-free area, parts of the aluminum foil remain attached to the removable foil. Normally, the parts remaining attached to the removable foil have the shape of a wedge. In order to prevent the wedge from extending up to the chambers whereby the closure of the chambers would be detrimentally affected and the product would be at least partially exposed, the distance between the chambers and the seal-free areas must be correspondingly large. This however is disadvantageous since the pack must then be relatively large.

In order to avoid the formation of such wedge-like release of the aluminum foil, the aluminum foil has been perforated along a line extending between the seal-free areas and the chambers. As a result, the rip wedge should be interrupted at the perforated line so that it does not extend into the area of the chambers containing the medicine. In this way, the distance between the seal-free zones and the chambers can be reduced so that the pocket can be smaller but it has been found that the arrangement is not reliable that is the rip wedge is not reliably terminated at the perforation line. Often, a new rip wedge is formed starting at the perforation line which detrimentally affects the closure of the chambers.

It is the object of the present invention to provide a blister pack of the type described above which however is relatively small and with which the chambers remain sealed, with high reliability, when the removable foil is removed from the pack.

SUMMARY OF THE INVENTION

In a blister pack comprising a base foil with chambers formed therein for receiving a product sealed into the chambers, a rupture foil disposed on the base foil to close and seal the chambers and a plastic foil disposed on the rupture foil for the protection of the rupture foil, wherein the plastic foil is attached to the rupture foil with a retaining force which is lower than the force with which the rupture foil is attached to the base foil, except for a limited edge area of the rupture foil which is delimited by a seal edge and a perforation extending along the seal edge, so that, upon removal of the plastic foil and the rupture foil from the base foil in the limited edge area where the rupture foil is not attached to the base foil, the rupture foil breaks away from the plastic foil when reaching the perforated seal edge so that the chamber remains reliably covered by the rupture foil while the plastic foil is peeled off the rupture foil.

It has been found that, if the perforation line extends along the seal edge, essentially no rip wedges are formed. As a result, in an advantageous manner, the distance between the seal-free area and the respective chamber does not need to be large. Furthermore, the area may have any shape; it may be round, triangular or rectangular. This has the advantage that the blister pack according to the invention can be very small.

It is furthermore very advantageous that no or only very small rip wedges are formed so that the possibility of damaging, the closure of one of the chambers is remote or even non-existent.

It has been found to be very advantageous if the perforations are provided during the connection of the aluminum foil to the base foil. In this way, the chances that the aluminum foil is ripped along the perforation line are further increased. The reason herefor may reside in the fact that the perforations are established at a point in time when the aluminum foil is not yet fully connected to the base foil.

Additional features and advantages of the invention will become more readily apparent from the following description of a particular embodiment thereof on the basis of the accompanying drawings:

DESCRIPTION OF A PARTICULAR EMBODIMENT

Figure 1:
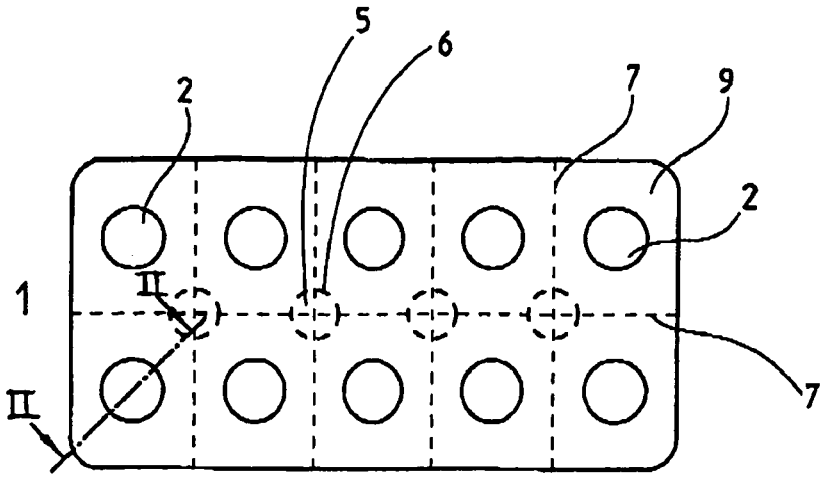
FIG. 1 shows a blister pack according to the invention with 10 chamber areas separated by perforation lines.

The blister pack shown in FIG. 1 includes ten chambers 2 which are arranged each in an area 9 of the blister pack divided by perforation lines 7.

Figure 2:
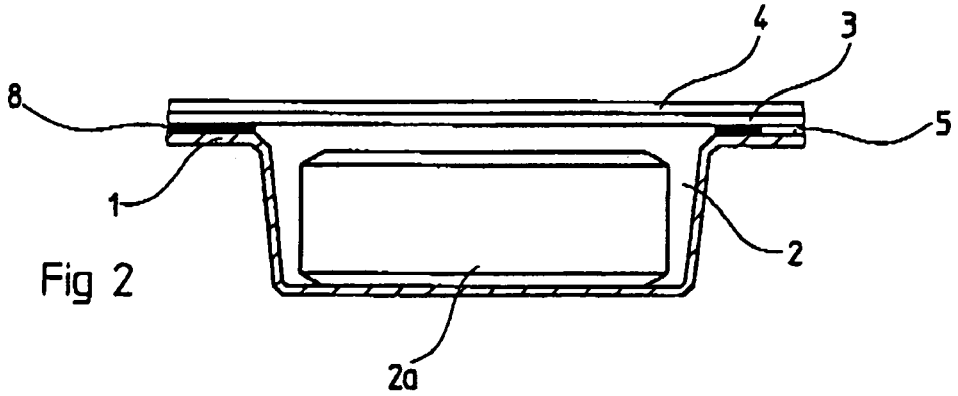
FIG. 2 is a cross-sectional view taken along line II—II of FIG. 1.
Figure 3:
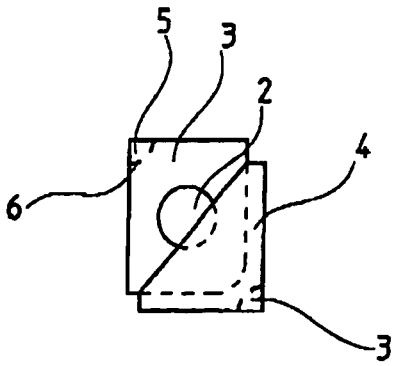
FIG. 3 shows an area separated from the pack of FIG. 1 along the perforation lines including one chamber and with the removable foil partly removed.

As shown in FIG. 2, the blister pack consists of a base foil 1 into which chambers 2 are formed by a cupping procedure and in which a product 2*a* is contained.

The chambers 2 are covered by a rupture foil 3 of aluminum. The aluminum foil 3 is attached to the base foil 1 by heating of a hot seal lacquer 8 which is disposed between the base foil 1 and the aluminum foil 3.

On the aluminum foil 3, that is, on the side thereof, remote from the base foil 1, a removable plastic foil 4 is disposed.

The attachment force with which the plastic foil 4 is connected to the aluminum foil 3 is smaller than the attachment force holding the aluminum foil to the base foil 1. As a result, the plastic foil 4 can be removed from the aluminum foil 3 while the aluminum foil remains firmly connected to the base foil 1.

As shown in FIG. 1, perforation lines 7 extend between the chambers of the pack. At the points of intersection between the perforation lines 7, there are circular areas 5 without hot seal lacquer 8 so that, in these circular areas 5, the aluminum foil 3 is not connected to the base foil 1. At each chamber cover area 9, there is therefore a perforation line section 6 delimiting an area where the aluminum foil 3 is not connected to the base foil 1.

If now an area 9 with a chamber 2 is separated from the rest of the blister pack along the separation line 7, the area 9 includes a part of the corner area 5 where the plastic foil 4 is not connected to the aluminum foil 3. Along the edge 6 of the seal-free area 5, the aluminum foil is perforated. The perforations have been formed during the sealing procedure when the aluminum foil 3 was connected to the base foil 1, that is, when the base foil 1, the hot seal lacquer 8 and the aluminum foil 3 were still warm.

The seal free corner area 5 of the aluminum foil 3 can be easily grasped by two fingers together with the plastic foil 4 connected thereto. As shown in FIG. 1, removal of the plastic foil 6 with the aluminum foil attached thereto causes the aluminum foil to be ripped exactly at the seal edge 6 since the aluminum foil 3 is perforated along the seal edge 6. The aluminum foil remains attached to the plastic foil 4 only as far as the aluminum foil is not attached to the base foil 1, that is, only the area 5 thereof remains attached to the plastic foil 4 and is removed together therewith. Outside the seal-free area 5, the base foil 1 remains completely covered by the aluminum foil 3 so that the chamber 2 remains safely covered by the aluminum foil 3.

What is claimed is:

1. A blister pack comprising a base foil (1) with at least one chamber (2) formed therein for receiving a product (2*a*), a rupture foil (3) disposed on said base foil (1) so as to close said at least one chamber (2), said rupture foil being firmly connected to the base foil (1) except for a limited area (5) which is delimited by a seal edge (6) along which the rupture foil is perforated, and a plastic foil (4) applied to the rupture foil (3) and being attached thereto with a retaining force which is smaller than the force with which the rupture foil (3) is attached to the base foil (1) so that, upon removal of the plastic foil and the rupture foil from the base foil in the area (5) where the rupture foil (3) is not attached to the base foil (1), the rupture foil breaks away when reaching the seal edge (6) whereby the chamber (2) remains securely covered by the rupture foil (3) while the plastic foil (4) is peeled off the rupture foil (3).

2. A blister pack according to claim 1, wherein the perforations of the rupture foil (3) along the seal edge (6) are formed during the application of the rupture foil (3) to the base foil (1).

* * * * *